United States Patent [19]

Liimatainen et al.

[11] Patent Number: 5,041,838

[45] Date of Patent: Aug. 20, 1991

[54] CELLULAR TELEPHONE ANTENNA

[76] Inventors: William J. Liimatainen, 60 E. Slade St., Palatine, Ill. 60067; Kevin Thill, 217 Marilyn, Glendale Heights, Ill. 60139

[21] Appl. No.: 489,416

[22] Filed: Mar. 6, 1990

[51] Int. Cl.[5] ..... H01Q 1/38

[52] U.S. Cl. ..... 343/700 MS; 343/713; 343/830

[58] Field of Search ..... 343/700 MS, 830, 846, 343/713, 873, 829, 848

[56] References Cited

U.S. PATENT DOCUMENTS

| | | | |
|---|---|---|---|
| 2,947,987 | 8/1960 | Dodington | 343/705 |
| 2,996,713 | 8/1961 | Boyer | 343/700 MS |
| 3,735,414 | 5/1973 | Rosenbluth | 343/769 |
| 3,914,676 | 10/1975 | Jones, Jr. | 343/708 |
| 4,051,480 | 9/1977 | Reggia et al. | 343/705 |
| 4,089,003 | 5/1978 | Conroy | 343/700 MS |
| 4,185,289 | 1/1980 | DeSantis et al. | 343/770 MS |
| 4,305,078 | 12/1981 | Jones, Jr. et al. | 343/708 |
| 4,329,689 | 5/1982 | Yee | 343/700 MS |
| 4,386,357 | 5/1983 | Patton | 343/700 MS |
| 4,401,988 | 8/1983 | Kaloi | 343/700 MS |
| 4,701,763 | 10/1987 | Yamamoto et al. | 343/700 MS |

FOREIGN PATENT DOCUMENTS

| | | | |
|---|---|---|---|
| 1140194 | 2/1985 | U.S.S.R. | 343/705 |

OTHER PUBLICATIONS

Paper written by inventors listed on Pat. No. 4,051,480 entitled "Conformal Dielectric-Filled Edge-Slot Antennas With Inductive-Post Tuning", IEEE Transactions on Antennas and Propagation, Sep. 1979.

"Flush-Mounted Antenna for Mobile Application", *Electronics*, D. R. Rhodes, Mar. 1949.

*Primary Examiner*—Michael C. Wimer

*Attorney, Agent, or Firm*—Quarles & Brady

[57] ABSTRACT

An planar antenna for use with a cellular telephone has a dielectric substrate with conductive coatings on its two major surfaces. A coaxial cable extends through a central aperture in the substrate with a shield of the cable connected to coating on one surface and a center conductor of the cable connected to coating on the other substrate surface. A number of shunts extend through the substrate electrically connecting the coatings on the two surfaces at points along a line that runs through the central aperture. Another shunt extends through the substrate electrically connecting the coatings on the two surfaces at a point which is not along the line of the other shunts. The position of the last shunt is non-uniformly spaced with respect to the other shunts and is selected to alter an electrical characteristic of the antenna to a desired value.

16 Claims, 1 Drawing Sheet

CELLULAR TELEPHONE ANTENNA

The present invention relates to cellular telephone apparatus and specifically to antennae for such apparatus.

BACKGROUND OF THE INVENTION

Cellular telephones are commonly used for mobile communication from vehicles. Such telephones usually have a hand held unit which includes a microphone, a small speaker, and a key pad for placing calls and controlling the operation of the telephone. The hand held unit is coupled by a cable to an electronics module that contains a radio frequency transceiver. Cellular telephones transmit in the 825 to 845 MHz frequency band and receive signals in the 870 to 890 MHz band. The transceiver utilizes a common antenna located on the exterior of the vehicle to send and receive these signals.

Typically, the antenna comprises a short section of rigid wire extending vertically from the vehicle body. Such antennae for operation at cellular telephone frequencies are relatively short, protruding approximately one foot from the surface of the vehicle. However, even such small antennae are subject to accidental breakage and acts of vandalism. Although cellular phone antennae are considered by some to be a status symbol, others may consider them to be unsightly and a detraction from the aesthetic appearance of the vehicle.

SUMMARY OF THE INVENTION

A cellular phone antenna, according to the present invention, comprises a planar assembly having a layer of dielectric material sandwiched between two layers of electrically conductive material. Preferably, the assembly is fabricated by coating opposite major surfaces of a dielectric sheet with a metal such as aluminum or copper to form the outer conductive layers. The assembly has a centrally located aperture through the three layers. A coaxial cable which couples the antenna to the cellular phone transceiver has its outer shield electrically connected to one of the conductive layers and its inner conductor extending through the centrally located aperture and electrically connected to the outer conductive layer.

A group of shunts are aligned along a line passing through the centrally located aperture and each shunt extends through the dielectric layer electrically connecting the two conductive layers of the antenna assembly. In the preferred embodiment, the shunts in this group are equidistantly spaced along the line on one side of the central aperture. One other shunt extends through the dielectric layer electrically interconnecting the two conductive layers at a position which is not aligned with the group of shunts. This other shunt is located at a position which tunes the antenna assembly to the desired range of frequencies utilized for cellular phone communication. In doing so, the plurality of shunts are non-uniformly spaced about the central aperture.

Preferably, the cellular phone antenna is mounted in the surface of another object so that the conductive material connected to the shield of the coaxial cable is in contact with that surface. For example, when the present antenna is utilized with a cellular telephone which is mounted in a vehicle, the antenna may be attached by an adhesive or other means to the roof of the vehicle. In such a case, the coaxial cable extends through a hole in the roof. However, the present antenna is not limited to use solely with cellular telephones mounted in vehicles, but may be utilized by attaching the antenna to the case of a portable cellular telephone.

DETAILED DESCRIPTION OF THE INVENTION

Figure 1:
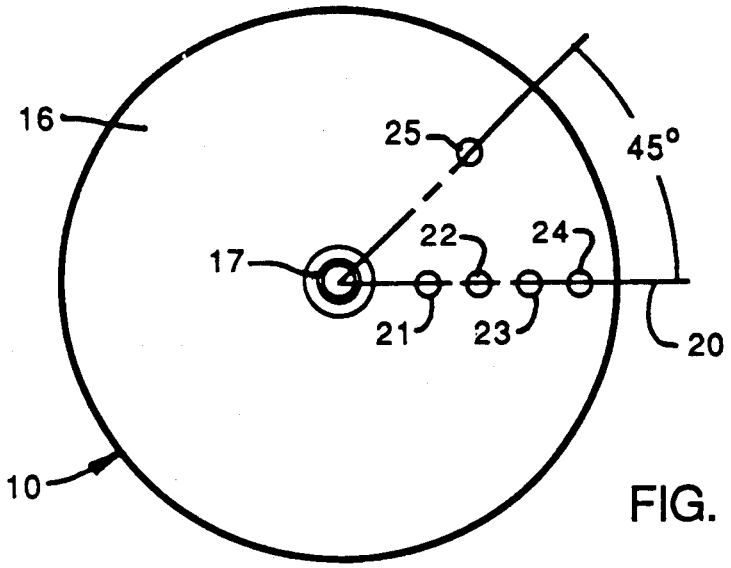
FIG. 1 is a plane view of one major surface of an antenna according to the present invention.

With reference to the drawings, a cellular telephone antenna 10 has a generally circular, planar shape. Preferably, the diameter of the antenna is less than one-half the wavelength of the cellular telephone signal in free space. Limiting the diameter in this manner prevents higher order modes from being excited. Although the present antenna is illustrated as having a circular shape, a rectangular or other geometrically shaped antenna may be used.

The antenna is formed by a substrate layer 12 of a dielectric material, such as a PTFE composite, with copper cladding electro-deposited on each of its major surfaces forming first and second outer conductive layers 14 and 16. The composite structure is approximately 0.125 inches thick. An aperture 18 is located at substantially the center of the antenna extending through the dielectric and conductive layers 12–16.

A coaxial cable 15 extends between the cellular telephone transceiver (not shown) and the antenna 10, being connected at a feed point that is substantially at the center of the antenna. Specifically, one end of the coaxial cable 15 extends into a brass ferrule 17 which is soldered to the second conductive layer 16 over aperture 18. The outer conductor, or grounded shield, of coaxial cable 15 is soldered to the ferrule 17. The cable's center conductor extends through the central aperture 18 in the antenna and is soldered to the first conductive layer 14. The center conductor of the coaxial cable 15 is electrically insulated from the second conductive layer 16 of the antenna. When the cellular telephone is in the transmitting mode, this cable connection applies the radio frequency signal between the two conductive layers 14 and 16.

Five shunts 21, 22, 23 and 24 extend through the substrate layer 12 electrically connecting the first and second conductive layers 14 and 16. Each shunt may be a 0.0625 diameter metal rivet which extends through an aperture in the antenna and contacts the two conductive layers 14 and 16. Alternatively the shunts may be formed by plated-through apertures.

The four of the shunts 21–24 are located along a line 20 on one of the major surfaces of the antenna, which line extends through the centrally located aperture 18. The locations and number of the shunts are selected to adjust the antenna's impedance so that the antenna is resonant at the frequency band for cellular telephone communication (i.e. 825–890 MGz). The antenna impedance is a function of the dielectric constant and thickness of the substrate layer 12. In order to determine the location of the shunts for a specific antenna design, the antenna is fabricated and each shunt 21–24 is positioned individually along line 20 while monitoring the antenna impedance or the standing wave ratio (VSWR) at the antenna center. As each shunt is placed through the antenna going from the center outward, the impedance and VSWR change becoming closer to the desired values prescribed by the output requirements of the cellular telephone transceiver. Typically the antenna has a nominal impedance of 70 ohms.

Another shunt 25 is required at a location that is not along line 20 in order to provide optimum impedance and VSWR for the typical transceiver. The fifth shunt 25 does not lie on line 20 and is at a position which is non-uniform with respect to the other four shunts 21–24. The exact position of the fifth shunt 25 also is determined to obtain best match of the impedance or VSWR of the antenna to the transceiver output requirements. Depending upon the shape and dimensions of a given antenna, additional shunts may be required at various locations to match the electrical characteristics of the antenna to those of the transceiver. A layer of fiberglass 26 is applied with an adhesive to the first conductive layer 14 as protection for the layer and the shunt rivets.

As a specific example, a cellular telephone antenna 10 according to the present invention has a diameter of three inches. The first shunt 21 is positioned at one-half inch from the center of the antenna and each subsequent shunt 22, 23 and 24 is positioned one-quarter inch along line 20 from the adjacent shunts. In this structure, the fifth shunt 25 is located on a radial line which is 45 degrees offset from the line 20 through apertures 21–24 are aligned and is spaced one inch from the center of the antenna 10.

Figure 2:
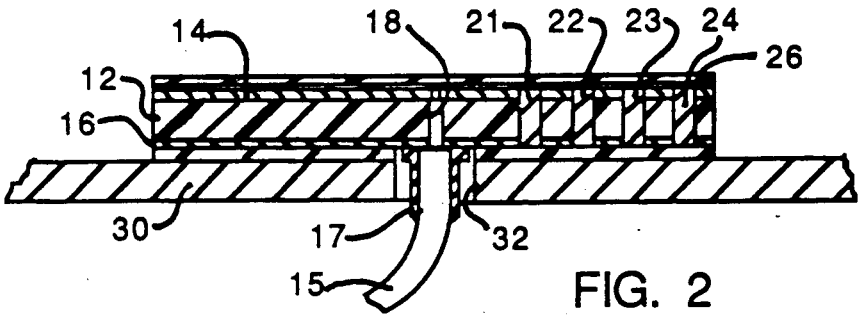
FIG. 2 is a cross section taken along the diameter of the circular antenna illustrated in FIG. 1.

As illustrated in FIG. 2, the second conductive layer 16 to which the ground shield of the coaxial cable 15 is attached by an adhesive to a support member 30, such as the roof of a vehicle within which the cellular phone is mounted. In this embodiment, the coaxial cable 15 passes through an aperture 32 extending through the support member 30.

We claim:

1. An antenna for a cellular telephone comprising:

a planar substrate of a dielectric material having two major surfaces;

a first electrically conductive layer on one of the major surfaces of said substrate;

a second electrically conductive layer on the other major surface of said substrate;

means for applying an excitation signal between and at substantially geometric centers of said first and second electrically conductive layers;

a plurality of shunts extending through said substrate and electrically connected to said first and second electrically conductive layers, said plurality of shunts being located along a first line coplanar with and extending radially from substantially the geometric center of said first electrically conductive layer; and an additional shunt extending through said substrate, electrically connected to said first and second electrically conductive layers, and located along a second line extending radially from substantially the geometric center of said first electrically conductive layer with no other shunts being located along the second line.

2. The antenna as recited in claim 1 wherein said substrate and said electrically conductive layers are circular having a diameter which is less than one-half the wavelength of the excitation signal.

3. The antenna as recited in claim 1 wherein said means for applying an excitation signal comprises a coaxial cable having a conductive shield connected to substantially the geometric center of said second electrically conductive layer, and having a central conductor extending through an aperture in said substrate and connected to substantially the geometric center of said first electrically conductive layer.

4. The antenna recited in claim 1 wherein said plurality of shunts consists of four shunts having an equal spacing therebetween.

5. The antenna as recited in claim 1 wherein said additional shunt is located on a second line coplanar with the first line and at a 45 degree angle thereto.

6. The antenna as recited in claim 1 wherein the position of said additional shunt is chosen to set the electrical impedance of the antenna at a given value for a band of frequencies used in cellular telephone communication.

7. The antenna as recited in claim 1 further comprising a layer of electrically insulating material applied to said first electrically conductive layer.

8. An antenna for a cellular telephone comprising:

a planar substrate of a dielectric material having two major surfaces;

a first electrically conductive layer on one of the major surfaces of said substrate;

a second electrically conductive layer on the other major surface of said substrate;

means for applying an excitation signal between and at substantially geometric centers of said first and second electrically conductive layers;

a single plurality of conductive means extending through said substrate and electrically connected to said first and second electrically conductive layers, each of said conductive means being located along a first line coplanar with and extending through substantially the geometric center of said substrate; and a conductive shunt extending through said substrate and electrically connected to said first and second electrically conductive layers and not located along the first line so that the shunt is not uniformly spaced with respect to said plurality of conductive means.

9. The antenna as recited in claim 8 wherein said substrate and said electrically conductive layers have a circular shape with a diameter that is less than one-half the wavelength of the excitation signal.

10. The antenna as recited in claim 8 wherein said means for applying an excitation signal comprises a coaxial cable having a conductive shield coupled to substantially the geometric center of said second electrically conductive layer, and a central conductor extending through an aperture in said substrate and coupled to substantially the geometric center of said first electrically conductive layer.

11. The antenna as recited in claim 8 wherein said plurality of conductive means consists of four electrical shunt means having substantially equal spacing therebetween.

12. The antenna as recited in claim 8 wherein said shunt is located on a second line coplanar with the first line and at a 45 degree angle thereto.

13. The antenna as recited in claim 8 wherein the position of said shunt is chosen so that the antenna has a predefined electrical impedance at a band of frequencies used in cellular telephone communication.

14. The antenna as recited in claim 8 further comprising a layer of electrically insulating material applied to said first electrically conductive layer.

15. An antenna for a cellular telephone comprising:

a planar substrate of a dielectric material having two major surfaces;

a first electrically conductive layer on one of the major surfaces of said substrate;

a second electrically conductive layer on the other major surface of said substrate;

means for applying an excitation signal between said first and second layers at points which are at substantially geometric centers of those layers;

a plurality of shunts extending through said substrate and electrically connected to said first and second layers, said plurality of shunts being located along a first line extending radially from the point on said first layer at which the excitation signal is applied; and at least one additional shunt extending through said substrate, electrically connected to said first and second layers, and positioned along a second line extending radially from the point on said first layer at which the excitation signal is applied with fewer shunts positioned along the second line than along the first line.

16. The antenna as recited in claim 15 wherein distances exist between each of said shunts and the point at which the excitation signal is applied, and wherein the distances are different for a shunt along the first line which is closest to the point at which the excitation signal is applied and for a shunt along he second line which is closest to the point at which the excitation signal is applied.

* * * * *